US005205575A

United States Patent [19]

Wladar

[11] Patent Number: 5,205,575

[45] Date of Patent: Apr. 27, 1993

[54] FRONT JAW

[75] Inventor: Helmut Wladar, Vienna, Austria

[73] Assignee: HTM Sport- und Freizeitgeraete Gesellschaft m.b.H., Schwechat, Austria

[21] Appl. No.: 499,387

[22] PCT Filed: Sep. 27, 1989

[86] PCT No.: PCT/EP89/01131

§ 371 Date: Jun. 6, 1990

§ 102(e) Date: Jun. 6, 1990

[87] PCT Pub. No.: WO90/03830

PCT Pub. Date: Apr. 19, 1990

[30] Foreign Application Priority Data

Oct. 7, 1988 [AT] Austria ..... A2480/88

[51] Int. Cl.[5] ..... A63C 9/08

[52] U.S. Cl. ..... 280/625; 280/634

[58] Field of Search ..... 280/634, 625, 628, 629

[56] References Cited

U.S. PATENT DOCUMENTS

| | | | |
|---|---|---|---|
| 4,336,956 | 6/1982 | Richert et al. | 280/625 |
| 4,538,828 | 9/1985 | Dimier | 280/628 |
| 4,889,359 | 12/1989 | Kowatsch et al. | 280/634 |
| 5,040,821 | 8/1991 | Berthet et al. | 280/625 |

FOREIGN PATENT DOCUMENTS

| | | | |
|---|---|---|---|
| 2030749 | 2/1979 | Fed. Rep. of Germany | 280/634 |
| 3343545 | 6/1984 | Fed. Rep. of Germany | 280/628 |

*Primary Examiner*—David M. Mitchell

*Attorney, Agent, or Firm*—Flynn, Thiel, Boutell & Tanis

[57] ABSTRACT

A front jaw having two laterally spaced toggle levers which can be swung out against the force of a release spring housed in a housing and through which housing extends a pull rod. In order to cause in this front jaw during a backward twisting fall an initial tension of the release spring and thus a reduction in the work of the swinging-out toggle lever, the invention provides that the two shorter lever arms of the toggle levers are loaded by a release spring acting through a pull rod onto an angular intermediate lever supported in the lower area of the housing on a first pivot axle.

5 Claims, 8 Drawing Sheets

FRONT JAW

FIELD OF THE INVENTION

The invention relates to a front jaw for holding a ski boot to a ski using a pair of toggle levers which laterally engage the sides of a toe region of the ski boot, and a sole down-holding mechanism oriented between the pair of toggle levers.

BACKGROUND OF THE INVENTION

Such a front jaw is already described in AT-PS 321 170. However, this front jaw has the disadvantage that the release spring is only slightly compressed during a backward twisting fall and thus the work to be done by the swinging-out toggle lever is reduced. During a forward fall, combined with a twisting fall, the release spring did not compress.

In a front jaw with laterally spaced toggle levers the measure of increasing the initial tension of the release spring during a combined frontal and twisting fall and thus reducing the work to be done during a swinging out of one toggle lever, is already known as shown by DE-PS 2 905 837. However, the effect occurs here only during a frontal fall and not also during a backward fall, which is combined with a twisting fall.

In a front jaw according to AT-PS 372 616, the shorter arms of the two toggle levers are supported on a bifurcated intermediate lever. The horizontal arm of the intermediate lever is thereby loaded by a separate sole down-holding means, which is arranged on a vertical locking bolt. Same is supported elevationally movably in a guideway in the base plate. Furthermore, the path of movement of the locking bolt is limited because of the design (compare AT-PS 372 616).

The purpose of the invention is to overcome the disadvantages of the known designs and to provide a particularly simple solution, with which an initial tension of the release spring occurs during a forward fall and during a backward fall, which falls can be combined with a twisting fall.

SUMMARY OF THE INVENTION

A front jaw having two laterally spaced toggle levers which can be swung out against the force of a release spring housed in a housing and through which housing extends a pull rod. In order to cause in this front jaw, during a backward twisting fall, an initial tension of the release spring and thus a reduction in the work of the swinging out toggle lever, the two shorter lever arms of the toggle levers are loaded by a release spring acting through a pull rod onto an angular movable intermediate lever supported on the housing for movement about a pivot axle. The housing consists of first and second parts, of which the first part is fastened to an upper side of the ski. The second part of the housing supports the pivot axle for the intermediate lever. The two toggle levers are pivotally supported each on a further pivot axle inclined with respect to the upper side of the ski. The second part is pivotal about a still further pivot axle extending spaced from the upper side of the ski.

BRIEF DESCRIPTION OF THE DRAWINGS

Exemplary embodiments of the subject matter of the invention are illustrated in the drawings.

DETAILED DESCRIPTION

Figure 1:
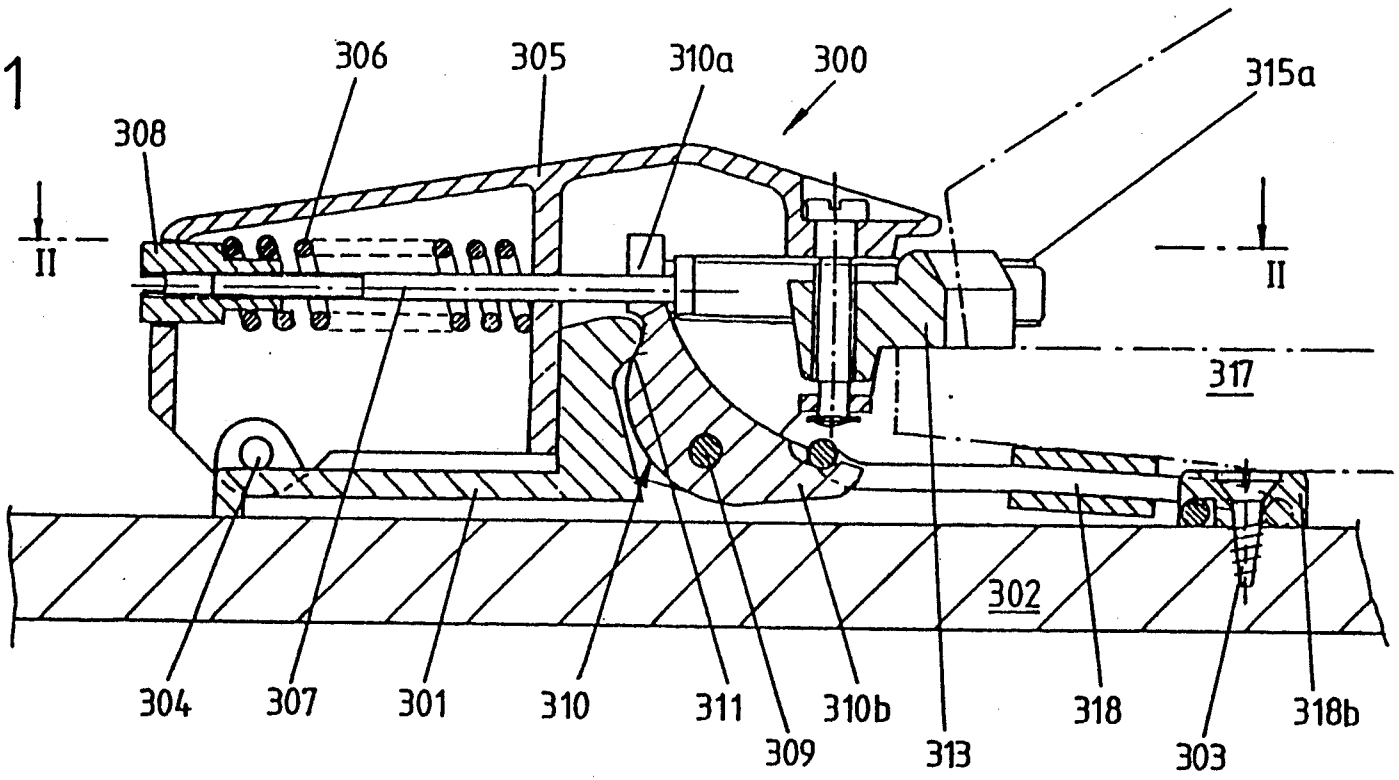
FIG. 1 is a vertical longitudinal center cross-sectional view of a first embodiment of a front jaw in the skiing position.
Figure 2:
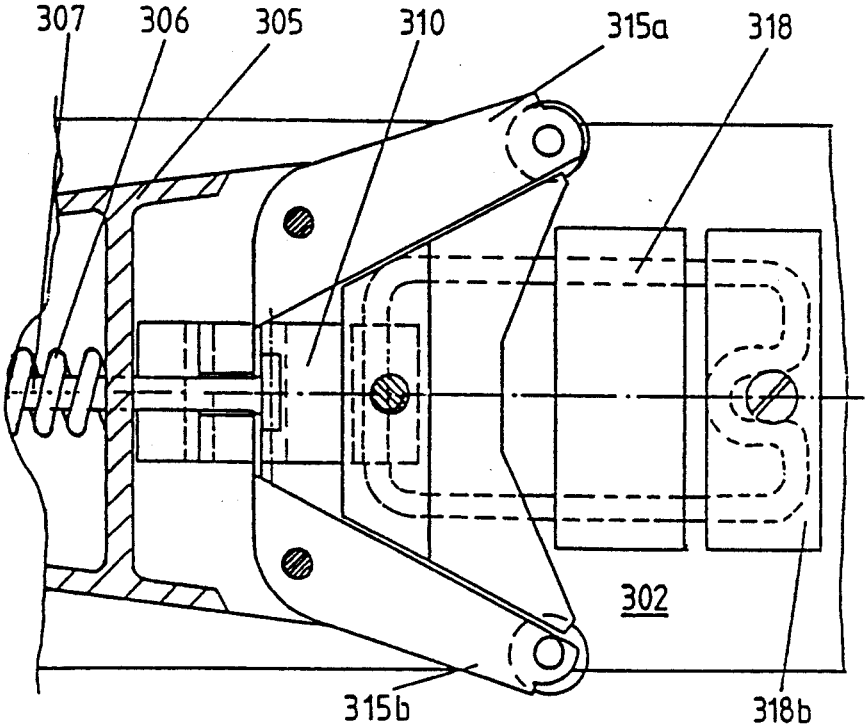
FIG. 2 is a cross-sectional view taken along the line II—II of FIG. 1.
Figure 3:
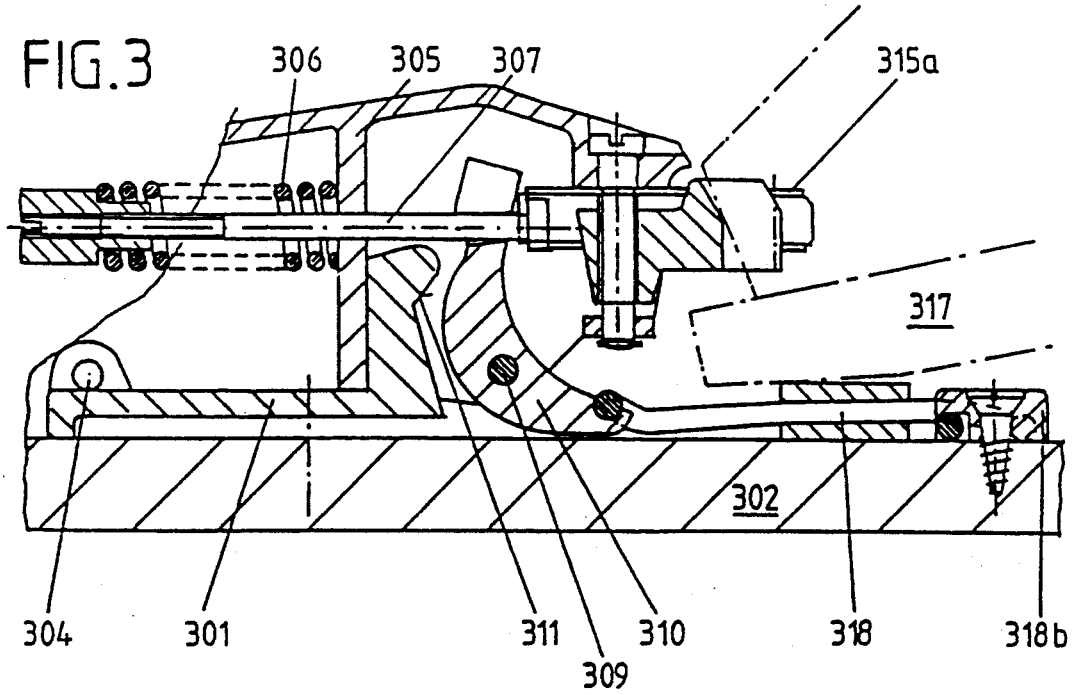
FIGS. 3 and 4 are vertical longitudinal center cross-sectional views of the front jaw during a frontal fall and during a backward fall.
Figure 4:
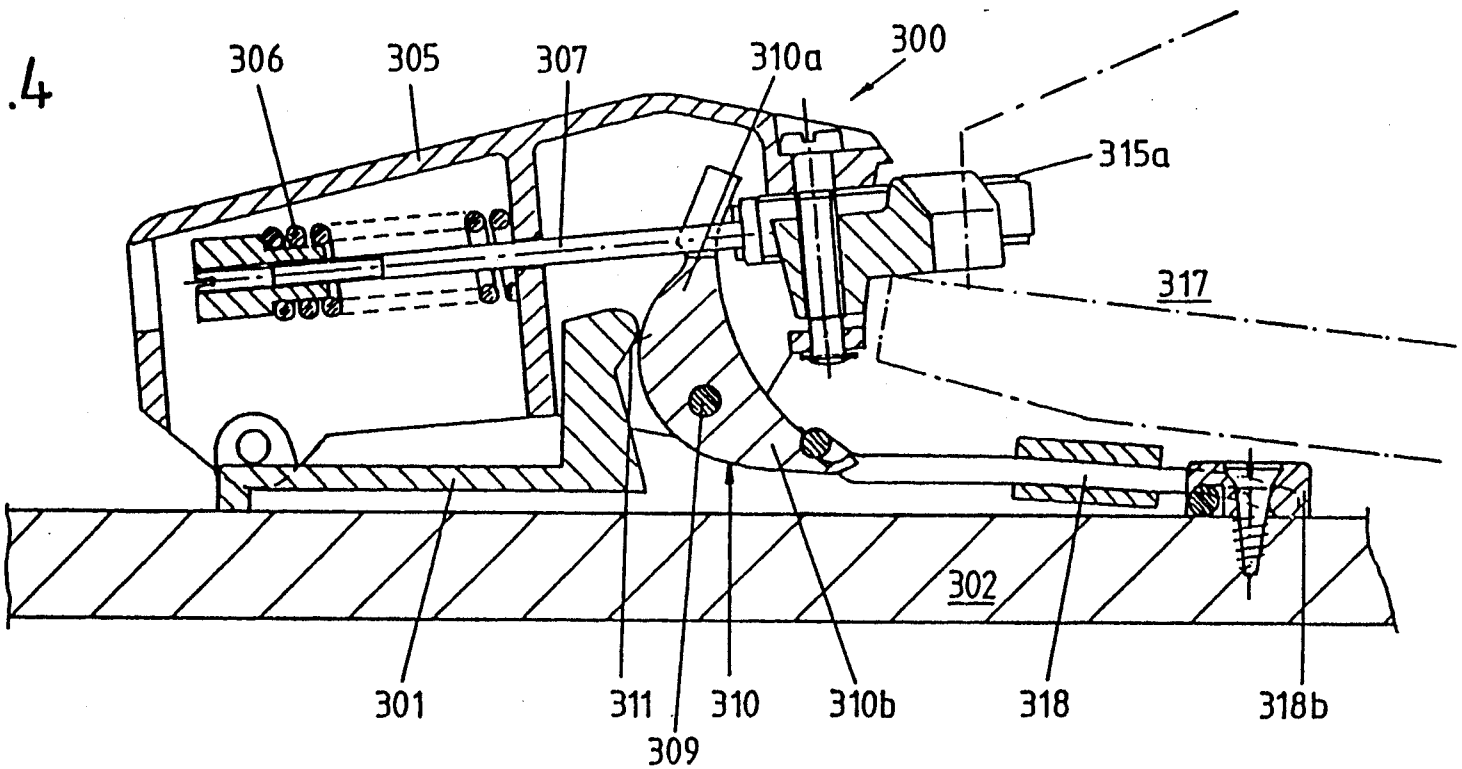

The front jaw illustrated in FIGS. 1 and 2 is identified in its entirety by the reference numeral 300. It has a base plate 301 secured on a ski 302 by means of screws 303. A pivot axle 304 extends transversely with respect to the longitudinal direction of the front jaw 300 and is arranged in the front area of the base plate 301. A housing 305 is supported on the front jaw 300.

The housing 305 has a release spring 306 therein, through which a pull rod 307 extends. The initial tension of the release spring 306 can be adjusted in a conventional manner by means of an adjusting nut 308 screwed onto the pull rod 307. A bifurcated angular intermediate lever 310 is supported in the housing 305 on a transverse axle 309. One lever arm **310*a* of the intermediate lever 310 rests in the skiing position of the front jaw 300 on a locking cam 311 of the base plate 301 and the other lever arm 310*b* of the intermediate lever 310 is used to support the free end of a pedal 318. The pedal 318 is manufactured of a multiply bent spring-wire material and is fastened on the ski 302 by means of one of its end areas and a locking member 318*b*. Reference numeral 313** identifies a sole down-holding means.

The elements of the front jaw 300 assume in the travelling position of the front jaw the position illustrated in FIG. 1. If the skier falls backward, the ski boot 317 lifts the sole down-holding means 313, and the housing 305 pivots about the pivot axle 304. The arm **310*a* of the intermediate lever 310 slides thereby along the locking cam 311 of the base plate 301, and the release spring 306 is compressed. As soon as the angle of traverse of the housing 305 is sufficiently large, the ski boot 317 leaves the front jaw 300**.

Whereas in the case of a pure twisting fall, one of the two toggle levers **315*a* and 315*b* is swung out against the force of the release spring 306 so that the ski boot 317 can leave the front jaw 300**.

If, however, a frontal fall is combined with a twisting fall in the front jaw 300, then the intermediate lever 310 is pivoted clockwise causing the release spring 306 to be initially tensioned more strongly through the pull rod 307. However, the work required for swinging-out the toggle lever **315*a* or 315*b* to compress the release spring 306** is reduced.

Figure 5:
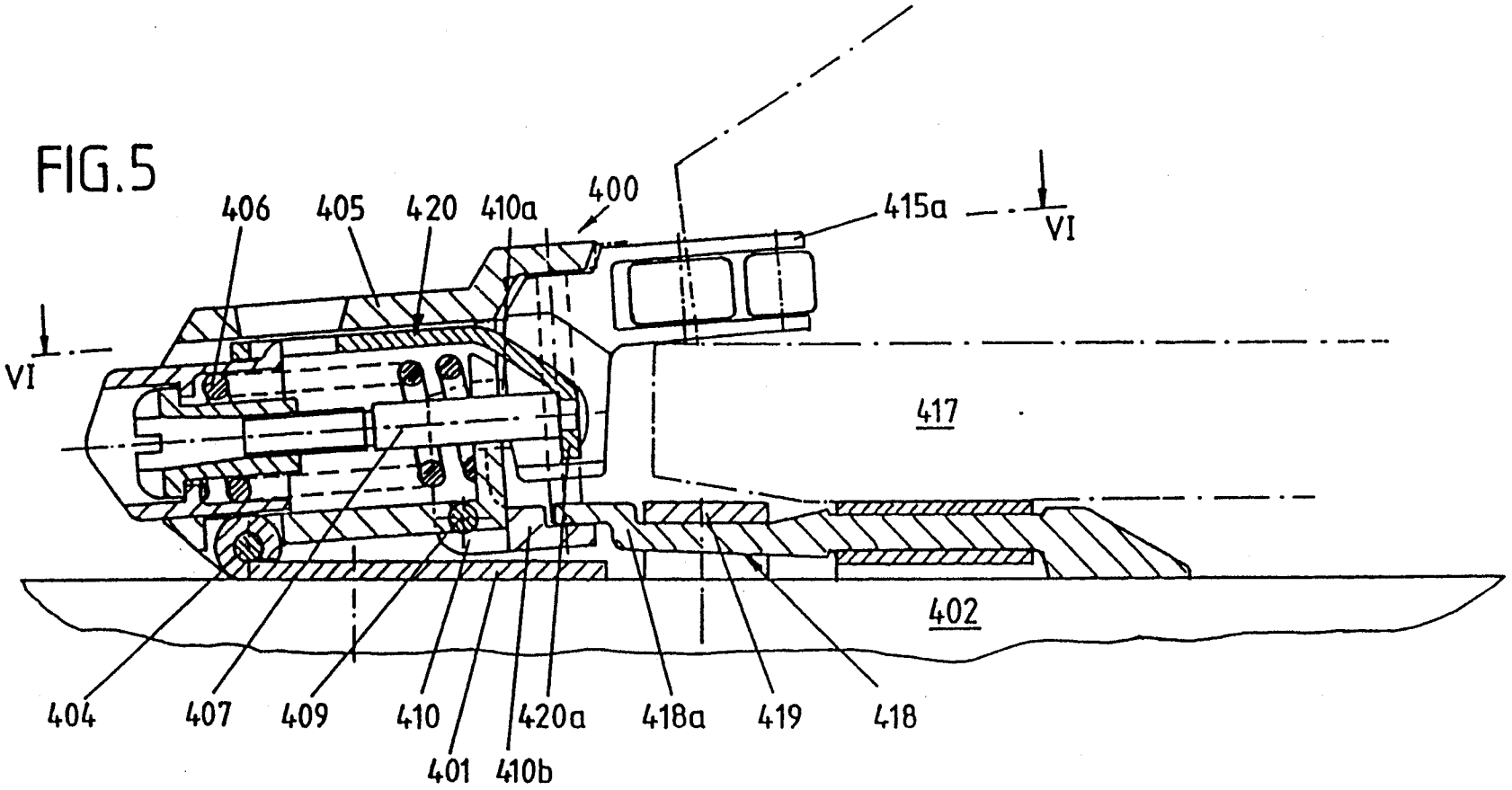
FIG. 5 illustrates a modification of the embodiment according to FIGS. 1 to 4 in a vertical longitudinal center cross-sectional view.
Figure 6:
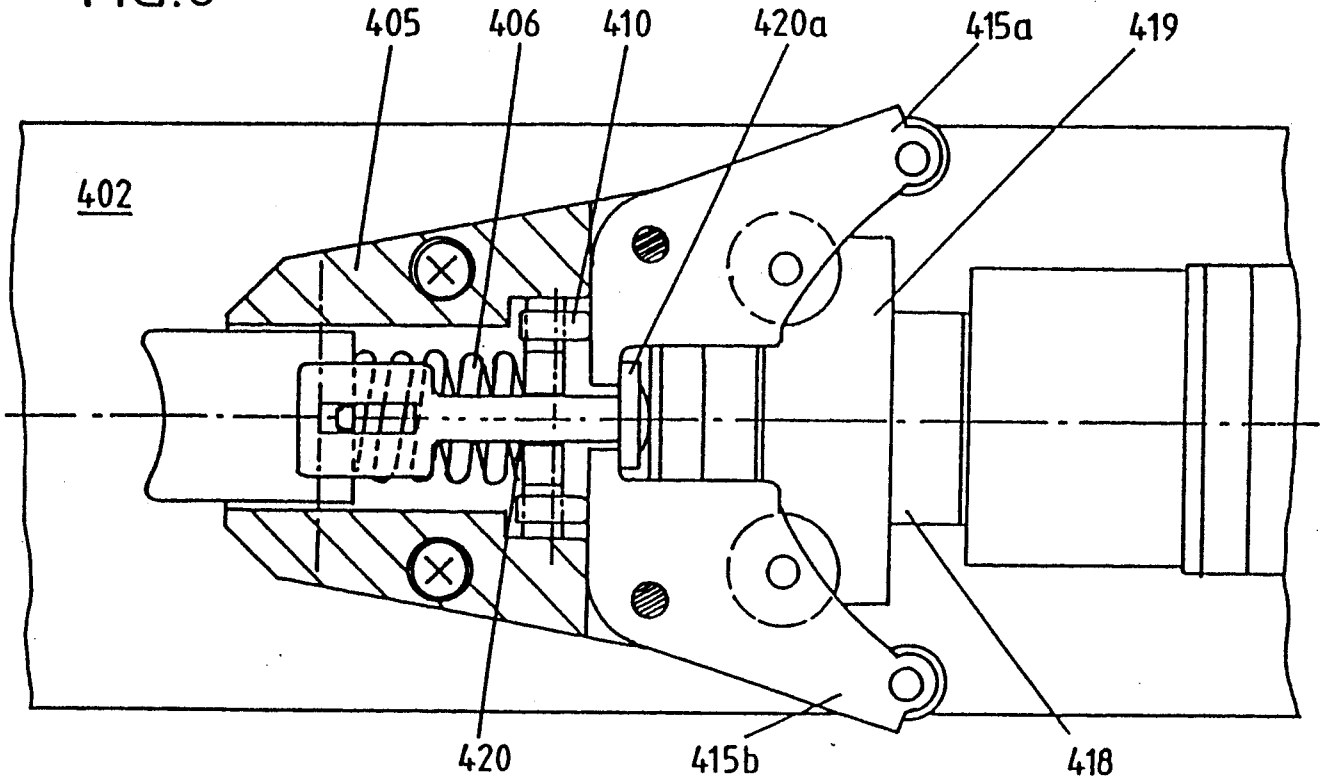
FIG. 6 is a cross-sectional view taken along the line VI—VI of FIG. 5.

The front jaw 400 illustrated in FIGS. 5 and 6 is distinguished by the two toggle levers 415*a* and 415*b* serving simultaneously as sole down-holding means and by a separate sole down-holding means therefore not being needed. Furthermore, the intermediate lever 410, which is supported on the axle 409 and which is forked in its arm 410*a*, does not have a locking projection of the base plate 401 associated with it. The front jaw 400 has inside of the housing 405 an angular slide member 420 which is movably guided in longitudinal direction of the ski and is loaded through a pull rod 407 by the release spring 406. The vertical arm 420*a* of the slide member 420 presses the ends of the two toggle levers 415*a* and 415*b* against the ski boot 417. The two toggle levers 415*a* and 415*b* rest thereby with their shorter arms always on the bifurcated vertical arm 410*a* of the intermediate lever 410. During a forward twisting fall, the two toggle levers 415*a* and 415*b* are swung outwardly by pivoting the pedal 418 and the intermediate lever 410 against the force of the release spring 406 and thus stepping out with the ski boot 417 is made easier.

During a backward fall of the skier in a front jaw 400, the pivoting of the intermediate lever 410 relative to the housing 405 is done clockwise so that the ski-fixed arranged, resiliently designed pedal 418 rests with a bent section 418*a* on the intermediate lever 410 and against a stop 419 fastened on the upper side of the ski 402. When the housing 405 is thereafter pivoted further by the ski boot 417, the release spring 406 is more strongly compressed by the intermediate lever 410, which also makes the swinging out of one of the two toggle levers 415*a* and 415*b* easier.

Figure 7:
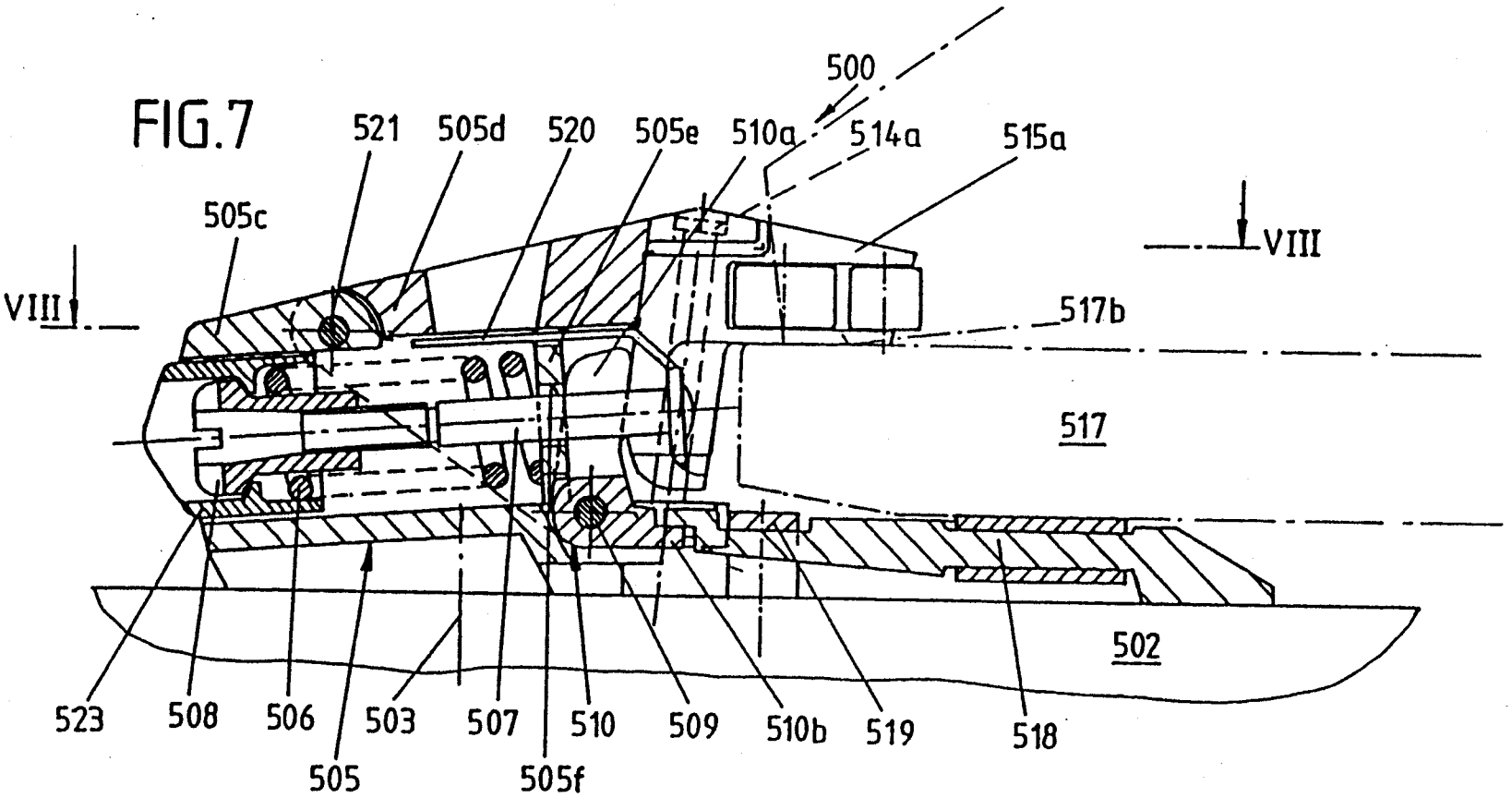
FIG. 7 illustrates a third embodiment in a vertical longitudinal center cross-sectional view in the skiing position.
Figure 8:
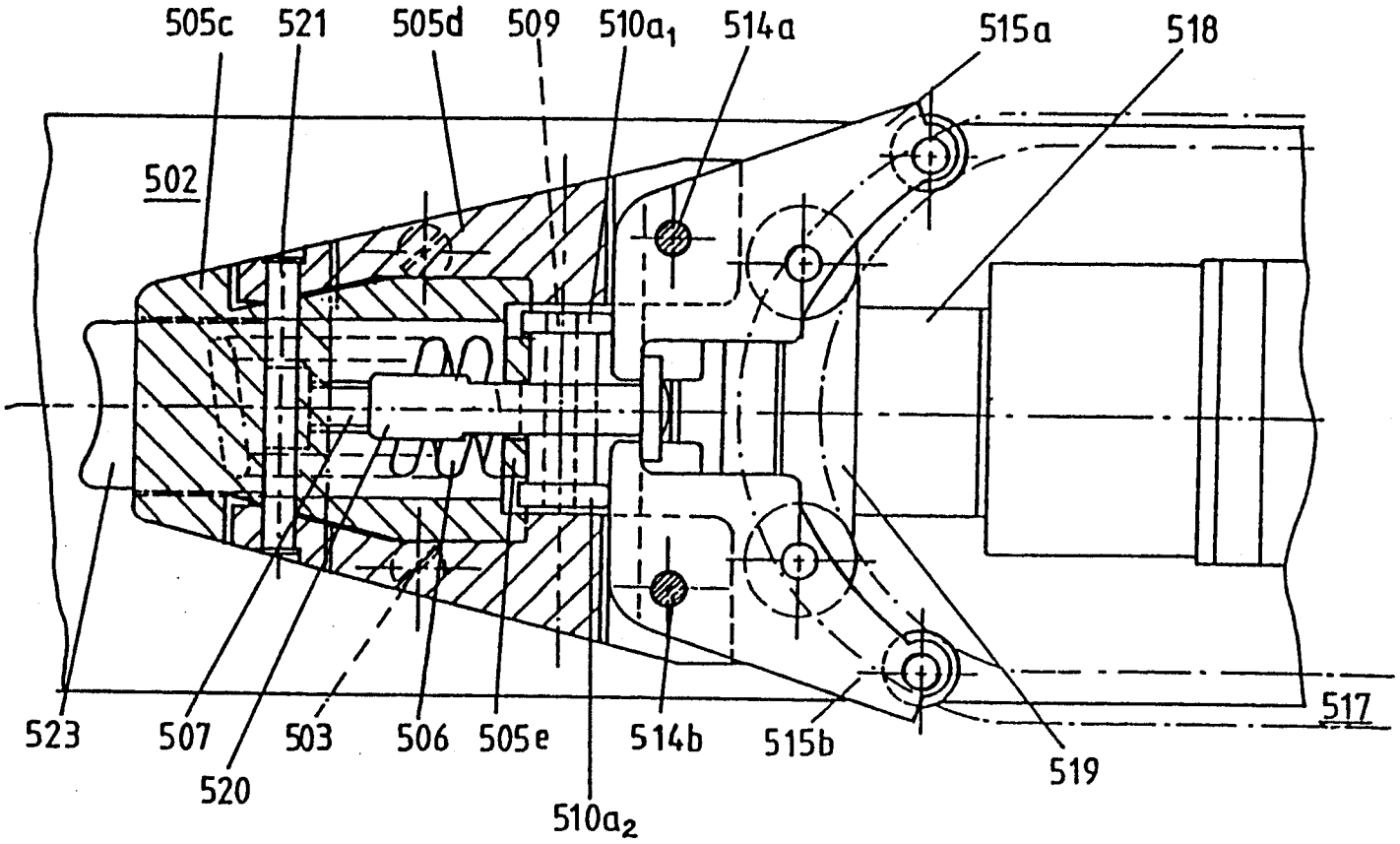
FIG. 8 is a cross-sectional view taken along the line VIII—VIII of FIG. 7.

In contrast to the front jaws which have been discussed up to now, in which the housing is made of one piece, the housing 505 in the front jaw 500 according to FIGS. 7 and 8 consists of two parts 505*c* and 505*d*, of which the one part 505*c* is fastened on the ski 502 by means of screws 503. The part 505*c* carries in the area remote from the ski 502 a pivot axle 521, on which the other second part 505*d* is supported. The part 505*d* carries the two pivot axles 514*a*, and 514*b* for the toggle levers 515*a* and 515*b* , which toggle levers again are designed as sole down-holding means. These two pivot axles 514*a* and 514*b* extend inclined with respect to the upper side of the ski 502 in direction toward the ski boot 517. The two toggle levers 515*a* and 515*b* are movably supported along the pivot axles 514*a* and 514*b* and each can be under the influence of a, here not illustrated, separate pressure spring arranged on the associated pivot axle 514*a* or 514*b*. The two toggle levers 515*a* and 515*b* can, however, also be pressed by the release spring 506 alone or in addition to same against the upper side of the sole 517*b* of the ski boot 517 under the condition that the inclination of the two pivot axles 514*a* and 514*b* and the initial tension of the release spring 506 are sufficiently great. The pull rod 507 is supported with its rear end through an angular slide member 520 on the shorter arms of the two toggle levers 515*a* and 515*b*. The front end of the pull rod 507 is pivotally supported by means of a spring abutment 523 in the first part 505*c* of the housing 505 through a ball-like adjusting nut 508, by means of which the initial tension of the release spring 506 can be adjusted. Furthermore, the shaft of the pull rod 507 is guided in elevational direction in a slotted hole 505*f* in a crosswall 505*e* of the first housing part 505*c*.

In a plane below the two toggle levers 515*a* and 515*b*, there is provided a further pivot axle 509 in the second part 505*d*, on which pivot axle 509 an intermediate lever 510 is supported, which is also designed as a toggle lever. One arm 510*a* of the intermediate lever 510 is divided into two prongs 510*a* and 510*a*$_2$ and the pull rod 507 extends therethrough. A ski-fixed arranged, resiliently designed pedal 518, the angle of traverse of which is limited upwardly by a ski-fixed stop 519, rests on the other arm 510*b* of the intermediate lever 510. The forked arm 510*a* rests in the skiing position by means of its prongs 510*a* and 510*a*$_2$ on the front sides of the two toggle levers 515*a* and 515*b*.

The pull rod 507 is in the front jaw 500 pivoted through a limited angle during a backward fall. The pull rod 507 is for this reason hingedly supported by means of the ball-like adjusting nut 508 at its front end in the spring abutment 523. The rear end of the release spring 506 is supported on the crosswall 505*e* of the first part 505*c*.

The individual parts assume in the rest position (with the ski boot inserted) the position illustrated in FIGS. 7 and 8. The toggle levers 515*a* and 515*b* have thereby adapted to the thickness of the sole 517*b* of the boot. Furthermore, the two toggle levers 515*a* and 515*b* have adjusted corresponding with the width of the ski boot 517 (compare FIG. 8). The gap created thereby between the shorter arms of the two toggle levers 515*a* and 515*b* and the two prongs 510*a* and 510*a*$_2$ of the intermediate lever 510 is balanced during the stepping in by a slight upward swing of the second part 505*d* and simultaneous pivoting of the intermediate lever 510 about the pivot axle 509.

The second part 505*d* is during a backward fall of the skier pivoted counterclockwise through the two toggle levers 515*a* and 515*b* such that also the pivot axle 509 for the intermediate lever 510 is lifted and the intermediate lever 510 itself is pivoted clockwise. It is thereby guaranteed that both toggle levers 515*a* and 515*b* rest at all times on the intermediate lever 510. This increases the initial tension of the release spring 506.

One of the two toggle levers 515*a* or 515*b* is during a backward twisting fall of the skier pivoted outwardly against the force of the release spring 506 such that the work to be done by the laterally swung-out toggle lever 515*a* or 515*b* is less than during a pure twisting fall.

If the twisting fall of the skier is combined with a frontal fall, then the intermediate lever 510 is pivoted also clockwise through the pedal 518, which again leads to a reduction of the work for the swung-out toggle lever 515*a* or 515*b*.

Figure 10:
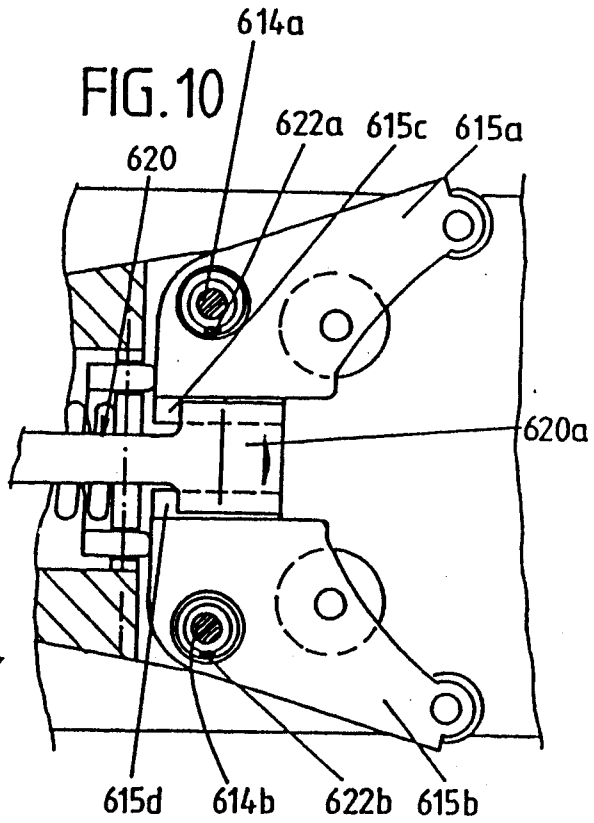
FIG. 10 is a cross-sectional view of a detail taken along the line X—X of FIG. 9.
Figure 9:
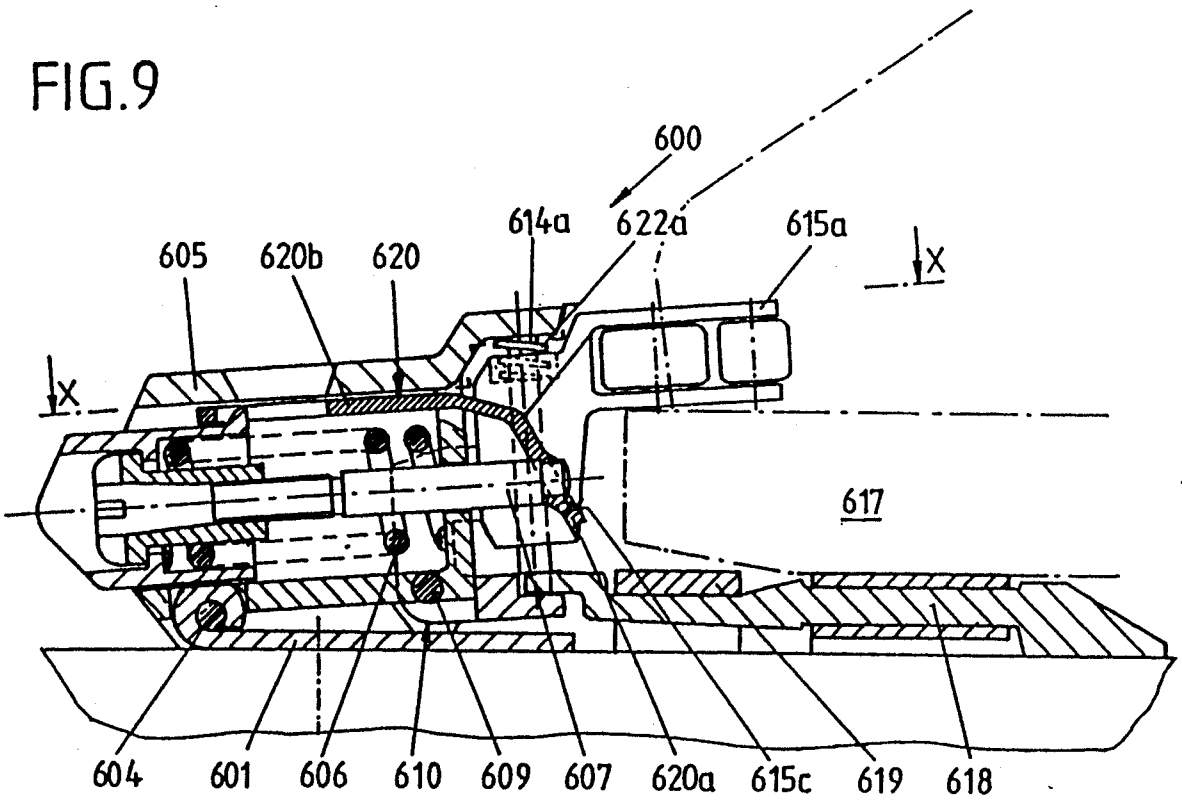
FIG. 9 illustrates a further embodiment in a vertical longitudinal center cross-sectional view.

A further design of a front jaw 600 is illustrated in FIGS. 9 and 10. The front jaw 600 has a housing 605 pivotally supported on a ski-fixed transverse axle 604, in which housing a release spring 606 is stored and centrally through which a pull rod 607 extends. The pull rod 607 is guided with both ends in the housing 605. Two bolts 614*a*, 614*b* extending approximately perpendicularly with respect to the upper side of the ski are fastened in the housing 605, on which bolts two toggle levers 615*a* and 615*b* are movably supported. The latter are under the influence of pressure springs 622*a* and 622*b*, the upper ends of which are supported on the housing 605.

An angular slide member 620 is furthermore supported in the housing 605, the shorter arm 620*a* of which slide member is riveted to the pull rod 607. The shorter arm 620*a* of the slide member 620 defines an obtuse angle with the longer arm 620*b* and rests flat on the inclined surfaces 615*c*, 615*d* of the two toggle levers 615*a* and 615*b*.

The remaining design of the front jaw 600 corresponds with the one illustrated in FIG. 5. The front jaw 600 has also an intermediate lever 610 which is supported on a pivot axle 609 in the housing 605 and the one arm of which is coupled with a pedal 618, the angle of traverse of which is defined by a ski-fixed stop 619.

The release function of the front jaw 600 corresponds with the one of the front jaw 400. A difference exists only in the two toggle levers 615*a* and 615*b* being designed as automatic sole down-holding means as has already been described in connection with the front jaw 500. A difference in design exists compared with the front jaw 500, which difference has already been pointed out above.

The invention is not to be limited to the exemplary embodiments illustrated in the drawings and described above. Rather various modifications of the same are possible without departing from the scope of the invention. For example, the two toggle levers do not need to have rollers, they can also be designed without rollers. Furthermore, the pressure springs illustrated in FIGS. 9 and 10 can also be used in the design according to FIGS. 7 and 8. Furthermore, the pedal is illustrated with a slipband (not identified in detail) in the drawing. However, this pedal could also be provided with a guide plate, for example made of polytetrafluoroethylene, or could be coated with such a material.

Also the pedal can be designed stiff according to the invention. In this case, it is pivotal relative to the ski about an axle and is under the action of an erecting spring. An axle arranged in a bearing can thereby be provided or the pedal can be pivotally supported about a geometric axis in an open space of a ski-fixed locking member. The spring can be designed for example as a torsion spring, a leaf spring or a cup spring package and can consist of metal, rubber or plastic material.

The embodiments of the invention in which an exclusive property or privilege is claimed are defined as follows:

1. In a front jaw having two pivotally supported, laterally spaced, two arm toggle levers, each having a long lever arm and a short lever arm, said toggle levers each being adapted to be swung laterally outwardly against a force of a release spring housed in a housing fastened to a base plate, and a pull rod extending through the housing, the improvement wherein said two short lever arms of said toggle levers are each loaded by said release spring in said housing acting through said pull rod on an angular intermediate lever pivotally supported in a lower area of said housing on a first pivot axle, said intermediate lever being operable by a pedal arranged on the ski, and wherein said housing consists of first and second parts, of which said first part is fastened to an upper side of the ski, wherein said second part supports said first pivot axle for said intermediate lever, and wherein said two toggle levers are pivotally supported each on a second pivot axle inclined with respect to the upper side of the ski, said second part being pivotal about a third pivot axle extending spaced from the upper side of the ski.

2. The front jaw according to claim 1, wherein said intermediate lever includes a horizontally extending lever arm; wherein said horizontally extending lever arm is coupled with said pedal, and wherein said pedal is resilient.

3. The front jaw according to claim 2, wherein said pedal rests with a bent section on said horizontally extending lever arm of said intermediate lever, and wherein a ski-fixed stop is provided for limiting an angle of traverse of said pedal is limited in its angle of traverse by a ski-fixed stop.

4. The front jaw according to claim 2, wherein a slide member guided in longitudinal direction of the ski is supported in said housing, on which slide member rest said short lever arms of said two toggle levers, and wherein said slide member is movable against the force of said release spring by said intermediate lever resulting from a stepping down on said pedal.

5. The front jaw according to claim 1, wherein said pull rod is supported pivotally at an end thereof remote from said toggle levers by means of a spring abutment in said first part of said housing; and wherein a shaft portion of said pull rod extends through a slotted hole in a crosswall of said first part.

* * * * *